US008635728B2

(12) United States Patent
Mapp

(10) Patent No.: US 8,635,728 B2
(45) Date of Patent: Jan. 28, 2014

(54) MODULAR RAMP SYSTEM

(76) Inventor: Michael Mapp, Annandale, VA (US)

( * ) Notice: Subject to any disclaimer, the term of this patent is extended or adjusted under 35 U.S.C. 154(b) by 0 days.

(21) Appl. No.: 13/493,417

(22) Filed: Jun. 11, 2012

(65) Prior Publication Data

US 2012/0277012 A1 Nov. 1, 2012

Related U.S. Application Data

(62) Division of application No. 12/230,355, filed on Aug. 28, 2008, now Pat. No. 8,196,244.

(51) Int. Cl.
*E01D 15/00* (2006.01)

(52) U.S. Cl.
USPC ..... 14/69.5; 472/89

(58) Field of Classification Search
USPC ..... 14/69.5; D34/32; 472/89
See application file for complete search history.

(56) References Cited

U.S. PATENT DOCUMENTS

D390,621 S * 2/1998 Cosentino ..... D21/817
5,777,266 A * 7/1998 Herman et al. ..... 174/68.1
6,654,977 B1 * 12/2003 Chin ..... 14/69.5
D500,113 S * 12/2004 Frey et al. ..... D21/817
6,993,801 B2 * 2/2006 Marko et al. ..... 14/69.5
7,003,836 B2 * 2/2006 Berg ..... 14/69.5
7,104,524 B1 * 9/2006 Hidding et al. ..... 254/88
7,591,605 B2 * 9/2009 Jonasz et al. ..... 404/15
7,595,450 B2 * 9/2009 Lubanski ..... 174/97
8,196,244 B2 * 6/2012 Mapp ..... 14/69.5
D663,092 S * 7/2012 Blocker ..... D34/32

* cited by examiner

*Primary Examiner* — Gary Hartmann

(57) ABSTRACT

A modular ramp system contemplates two molded plastic ramps placed back-to-back so that one would travel up one ramp and then down the other. The ramps are interconnected by a spine. The spine connectors are dovetail recesses and projections. The ramps have connections on their sides, so other ramps may be assembled to the two ramps to make a wider ramp. The ramp can have a plurality of ramp sections assembled together to create a ramp. A table is designed to be used with ramps and other components and includes openings facilitating installation of a grind rail or a support rail. The table surface includes a peripheral coping. A grind rail includes legs with arcuate bottoms to facilitate support of a grind rail regardless of angulation. Curved sections of grind rails allow lateral and vertical curvature of a grind rail configuration. Connectors are provided to interconnect adjacent grind rail sections.

20 Claims, 12 Drawing Sheets

MODULAR RAMP SYSTEM

This application is a divisional of application Ser. No. 12/230,355, filed on Aug. 28, 2008, which matured into U.S. Pat. No. 8,196,244 on Jun. 12, 2012. The drawings presented with this divisional application are the replacement formal drawings that were filed in Ser. No. 12/230,355 as a result of the Notice from the USPTO dated Nov. 12, 2008.

BACKGROUND OF THE INVENTION

The present invention relates to improvements in a modular ramp system. Ramp components of a variety of kinds are well known in the prior art for use by skateboarders. Angled ramps, radiused ramps, tables, quarterpipes, halfpipes, rails and other components are generally well known for use by skateboarders riding skateboards who enjoy skating on such devices for recreation as well as for competition. Applicant is the patentee of U.S. Pat. No. 5,946,756 that issued Sep. 7, 1999, and was later reissued as Reissue U.S. Pat. No. RE 38,326 on Sep. 25, 2003. Applicant's prior patent and reissue patent disclose a molded plastic ramp made in a one step molding process and including a smooth radiused ramp surface. The invention disclosed in Applicant's prior patent and reissue patent was successfully commercialized and remains one of the most popular ramps in the marketplace today. Its combination of portability, high strength, radiused ramp surface, and easy access to the ramp surface via its forward edge have combined together to create an extremely popular product.

However, although Applicant's commercialized and patented ramp is a popular product, it is a product that may only effectively be used by itself because it was never designed to interface with other kinds of skateboarding surfaces that have evolved over the years.

As skateboarding has become more and more popular over the past several decades, both as a recreational sport and as a sport where amateurs and professionals compete for prizes including money, numerous municipalities have concluded that it is appropriate to provide skateboarding parks within their borders. As such, skateboarding parks have sprung up all over the United States, generally consisting of permanent fixtures such as poured concrete bowls, quarterpipes and halfpipes as well as permanently installed wooden and metal structures providing numerous varieties of jumps, curves, tracks, surfaces, and other features attractive to skateboarders. Not every municipality, however, has the financial means or the land area to provide skate parks for their citizens. Thus, it is has become advantageous to create modular components combinable together in a variety of orientations and that may easily be assembled for use and disassembled for storage and even transport. Such modular systems are also attractive to private citizens who may, for example, have a driveway where such components may be assembled, but who require the ability to disassemble and store those components when the driveway is to be used, for example, by vehicles or for other uses such as a basketball court or volleyball court.

U.S. Pat. No. 6,993,801 to Marko et al. discloses a modular ramp system that includes a series of components that may be assembled together in a variety of ways to create different features. The Marko et al. system contemplates a variety of ramps including extensions and tables that may be assembled together. These components are assembled together using T-shaped female slots and T-shaped male projections that interface with one another to allow strong assembly together as well as ease of disassembly for storage. While Marko et al. generally teach the concept of a modular system of components that may be assembled together in a variety of configurations, the types of components contemplated by Marko et al. are limited as compared to the teachings of the present invention.

Additionally, a variety of individual components used by skateboarders are known in and of themselves. However, Applicant is unaware of any prior art teaching combining together a variety of skateboarding components in the unique ways contemplated herein. The following additional prior art is known to Applicant.

U.S. Pat. No. 3,848,534 to Beck et al. discloses a wiggle track section designed for use with railroad cars. Beck et al. fail to teach or suggest the use of curved and other non-straight track sections used for a rail system for skateboarding.

U.S. Pat. No. 5,524,310 to Farnen discloses modular halfpipe skateboard ramp and method of constructing. Farnen teaches a plurality of components designed to be assembled together using fasteners to create a halfpipe. Farnen fails to teach or suggest the concept of a plurality of modular skateboard components of differing types that may be assembled together in a variety of ways.

U.S. Pat. No. 6,042,480 to Labelson discloses an amusement ramp and method of constructing it. Labelson contemplates two back-to-back ramps assembled together. However, Labelson fails to teach or suggest the specific manner of interconnection of back-to-back ramps contemplated by the present invention.

U.S. Pat. No. 6,061,979 to Johannes teaches an inline skating sports floor including a plurality of sections assembled together using hooks and loops. Johannes fails to teach or suggest the modular ramp system of the present invention including the particular manner of interconnection of various components contemplated herein.

U.S. Pat. No. 6,547,221 to Bork et al. discloses a grind rail system that may be assembled and disassembled. In Bork et al., the various components are assembled together using aligned holes and pins. By contrast, the present invention contemplates the use of dovetail recesses and projections. Moreover, Bork et al. teach supports that include circular cross-section ground engaging portions. However, there is no teaching or suggestion by Bork et al. that the support legs are intended to accommodate sloped support of a grind rail.

U.S. Pat. No. 6,551,192 to Rieber et al. discloses an obstacle assembly for bikes, skateboards, and rollerblades including the proviso of interconnecting a plurality of diverse components together. Among those components are ramps and grind rails. With particular attention to the grind rails, they include circular cross-section feet, however, the feet are attached to legs fixedly mounted under the grind rails without any stated intention to accommodate to supporting a grind rail in a sloped configuration.

U.S. Pat. No. 6,623,367 to Labelson et al. is similar to Labelson '480 and discloses a ramp consisting of back-to-back radiused ramps interconnected together. Labelson et al. also teach a halfpipe configuration. Labelson et al. also teach the use of hand rails assembled to a ramp system. The present invention differs from the teachings of Labelson et al. in many respects including the manner of interconnection of diverse modular components.

U.S. Pat. No. 6,672,968 to Montolio teaches a modular skate park system in which a variety of ramps and tables may be assembled together. Montolio fails to teach or suggest the variety of modular components contemplated by the present invention nor their manners of interconnection.

U.S. Pat. No. 6,676,529 to Pernal discloses an amusement ramp system in which a ramp may be associated with a table at its upper end and in which a plurality of ramps and tables may be laterally connected. Pernal also contemplates a plurality of components that may be combined together to form a halfpipe. The present invention differs from the teachings of Pernal as contemplating a multiplicity of modular components that may be assembled together in manners not taught or suggested by Pernal.

U.S. Pat. No. 6,782,577 to Rieber et al. discloses a knock-down quarterpipe for skateboarders, bikers and in-line skaters. The Rieber et al. device includes a support frame to which ramp sections may be assembled. However, Rieber et al. fail to teach or suggest the multiplicity of modular components combined together as disclosed herein nor their respective manners of interconnection.

U.S. Pat. No. 7,048,634 to Fernandez et al. discloses a skateboard rail that includes dovetail connections to allow adjacent rails to be interconnected. Fernandez et al. also teach a table having integral coping on its sides. However, Fernandez et al. fail to teach or suggest the multiplicity of modular components contemplated in the present invention nor their respective manners of interconnection.

U.S. Pat. No. 7,104,895 to Hickey discloses an extreme sports ramp system including a frame with support legs and ramp sections assembled thereto. Hickey fails to teach or suggest the modular components of the present invention nor their respective manners of interconnection.

U.S. Pat. No. 7,195,562 to Soderberg discloses a knock-down skateboard park system. Soderberg contemplates a plurality of components including a ramp, table and hand rail that may be assembled together. Additional features include the ability to combine a plurality of ramps with at least one table. The manner of interconnection contemplated includes the use of specific clips. The present invention differs from Soderberg as contemplating a multiplicity of modular components that may be assembled together in ways not taught or suggested by Soderberg.

U.S. Pat. No. 7,273,443 to Martinez et al. discloses a portable interlocking skate rail assembly that includes a plurality of rail components that may be coupled together. The coupling system contemplates square cross-section female portions into which square cross-section male portions are inserted. The present invention differs from the teachings of Martinez et al. in numerous respects including as contemplating a plurality of rail sections including those permitting curves in a length of rail.

U.S. Published Patent Application No. US 2002/0050589 A1 to Nestel discloses a portable grind rail assembly in which a plurality of grind rail sections are assembled together using connecting pipes having outer diameters corresponding to the inner diameters of rail sections and pushbutton coupling members designed to be pushed in, slid into the rail sections, and then popped out at holes provided in the rail sections. The present invention differs from the teachings of Nestel as contemplating numerous different types of rail sections nowhere taught or suggested by Nestel.

U.S. Published Patent Application No. US 2002/0093165 A1 to Greene discloses a human powered skateboard roller coaster. The Greene invention shows a plurality of rails including curved sections and sections that extend upwardly and downwardly. The present invention differs from the teachings of Greene as contemplating incorporating grind rails as a portion of a modular skateboard system.

U.S. Published Patent Application No. US 2003/0196308 A1 to Kelsey discloses a grind rail and transport kit in which a variety of rail sections are coupled together. Kelsey fails to teach or suggest the modular system of the present invention.

U.S. Published Patent Application No. US 2005/0075177 A1 to Bork et al. discloses a ramp system in which back-to-back ramps are held in angled relationship to one another by an interconnecting arm. The present invention contemplates a distinctly different mechanism for interconnecting back-to-back ramps.

U.S. Published Patent Application No. US 2005/0107170 A1 to Wang discloses a skateboard ramp system in which a plurality of ramp sections may be assembled together to create a lengthier ramp. Wang contemplates the use of swallow-tailed grooves and swallow-tailed tongues to interconnect the differing ramp sections. The present invention differs from the teachings of Wang as contemplating a plurality of different modular skateboarding components that may be assembled together in a variety of configurations.

U.S. Published Patent Application No. US 2005/0124425 A1 to Talafous discloses a skate training system including a ramp made up of several sections mounted together. The present invention differs from the teachings of Talafous as not being limited merely to skateboard ramps.

U.S. Published Patent Application No. US 2007/0015594 A1 to Laurienzo et al. discloses a stunt ramp for a wheeled toy device which consists of two back-to-back radiused ramps interconnected together in an integral housing. The present invention differs from the teachings of Laurienzo et al. as contemplating two separate constructed radiused ramps that are assembled together back-to-back through the use of a spine connector.

As more of an overview, the present invention distinguishes from the teachings of all of the prior art known to Applicant as identified and discussed above because the present invention contemplates combinations of elements and structures nowhere taught or suggested in any of the prior art references whether taken alone or in any combinations that could reasonably be considered to be evidence of obviousness under the Patent Statutes. Those combinations of elements include, as described in greater detail below, but are not limited to, the following:

(1) The use of radiused ramps laterally connected together with the respective ramps achieving differing heights.

(2) Use of a table having an integrally molded coping bump with the table utilized in combination with a launch ramp or quarterpipe.

(3) Modular ramp components allowing conversion of a launch ramp into a quarterpipe.

(4) Use of a grind rail including straight and curved sections, either alone or in combination with a skateable table.

(5) A unique connection system facilitating assembly of two ramps back-to-back while permitting lateral interconnection of similar combinations or two sets of back-to-back ramps of differing heights.

(6) Legs used to support grind rails and tables that include arcuate ground engaging surfaces allowing stable support on both flat and inclined ground surfaces.

SUMMARY OF THE INVENTION

The present invention relates to improvements in a modular ramp system. The present invention includes the following interrelated objects, aspects and features:

(1) In a first aspect, the present invention contemplates a new way of interconnecting two ramps. In particular, two molded plastic ramps are placed back-to-back with one another so that in a direction of travel, one would travel up one ramp and then immediately down the other. The ramps are interconnected by virtue of a spine that includes connectors that interface with connectors provided on the facing surfaces of the ramps. In the preferred embodiment of the present invention, the connectors consist of dovetail recesses and dovetail projections. The dovetail projections may be on the spine or may be on the ramps, with the dovetail recesses that enmesh with the dovetail projections being on the other one of the respective components. The ramps also have connection structure on their lateral sides. In this way, other ramps may be assembled to the two back-to-back ramps to make a ramp that is incrementally wider. The ramps may be made in any suitable elevation from bottom to top and any desired radius of curvature on the ramp surfaces thereof. The only proviso is that in order to interconnect the ramps together, front to rear, they must have substantially equal heights.

(2) In a further aspect, a ramp usable in the inventive modular ramp system contemplates a plurality of ramp sections that may be assembled together to create a ramp. Each of the sections includes a top surface comprising a portion of the integrated ramp surface when all of the components are assembled together. Assembly is by virtue of dovetailed grooves and projections that interface in the abutting component parts to allow firm assembly and ease of disassembly for storage.

(3) Each ramp section includes inserts on a bottom surface that may be made of a non-slip material such as, for example, rubber, so that the ramp stays in place particularly when a skateboarder skates onto the ramp surface thereof. Dovetailed grooves or projections are located about the sides of the ramp components to allow a plurality of ramps to be assembled together side-to-side to create a wider ramp surface for a skateboarder. The ramp sections may be provided in a plurality of radii of curvature to permit composite ramps of different radii of curvature as well as differing heights to be created.

(4) The present invention also contemplates a new type of table designed to be used with ramps and other components. The inventive table of the present invention includes a plurality of openings therethrough designed to facilitate installation of a grind rail or a support rail. The table surface includes peripheral coping consisting of an upraised bump. This upraised bump is integrally formed with the table during manufacture to ensure economy, safety and convenience.

(5) The present invention also contemplates a variety of features in a grind rail system. Those features include support legs with arcuate bottoms to facilitate safe support of a grind rail regardless of angulation. Also contemplated are curved sections for grind rails that allow lateral and vertical curvature of an elongated grind rail configuration. Connectors are provided to interconnect adjacent grind rail sections.

(6) Based upon the teachings of the present invention as explained above, the various components of the present invention may be combined together in a variety of ways to create a skating facility of great novelty and utility and which may be enjoyed by skateboarders, but may easily be assembled for use and disassembled for storage and transport. Numerous examples are contemplated within the teachings of the present invention. For example, a plurality of ramps including those made up of a plurality or multiplicity of ramp sections may be assembled together with lateral interconnections to widen the ramp surface. Such composite ramps may also be augmented through the use of one or more tables connected at the top of each ramp. If desired, additionally, a grind rail having a multiplicity of rail components interconnected together may be coupled to a ramp or table to enhance use or may be used separately. The grind rail sections may be supported by legs interconnected by a bar having an arcuate ground engaging surface that helps facilitate support of grind rails even at angular relationships with respect to a ground surface.

(7) Ramps may be created by assembling two ramps back-to-back through the use of a spine connector. If desired, back-to-back ramp assemblies having differing elevations may be laterally interconnected to enhance use.

(8) Tables made in accordance with the teachings of the present invention may include integrally molded coping to provide a periphery that enhances safety. Numerous other combinations and permutations of the ramp components disclosed herein may be contemplated by those of ordinary skill in the art.

Accordingly, it is a first object of the present invention to provide improvements in a modular ramp system.

It is a further object of the present invention to provide such an invention in which two ramps may be releasably assembled together, back-to-back, through the use of a spine connector.

It is a still further object of the present invention to provide interconnection between two back-to-back ramps using a spine connector and with the use of dovetail connections to releasably interconnect the components.

It is a still further object of the present invention to provide a table with an integral coping to enhance safety and reliability.

It is a yet further object of the present invention to provide such a system in which one or more tables are releasably coupled to one or more ramps to provide additional width and additional size to a temporary skateboard park.

It is a still further object of the present invention to provide ramps having differing radii of curvature as well as differing elevations.

It is a yet further object of the present invention to provide skateboard ramps made in a multiplicity of sections releasably assembled together.

It is a still further object of the present invention to provide non-skid surfaces on the undersides of modular ramp components so that they do not move when a skateboarder skateboards onto them.

It is a still further object of the present invention to provide such a system in which grind rails include numerous sections having differing curvatures and differing straight sections all coupled together to provide a unique grind rail system.

It is a yet further object of the present invention to combine various ones of the individual components of the present invention to create a portable skate park.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
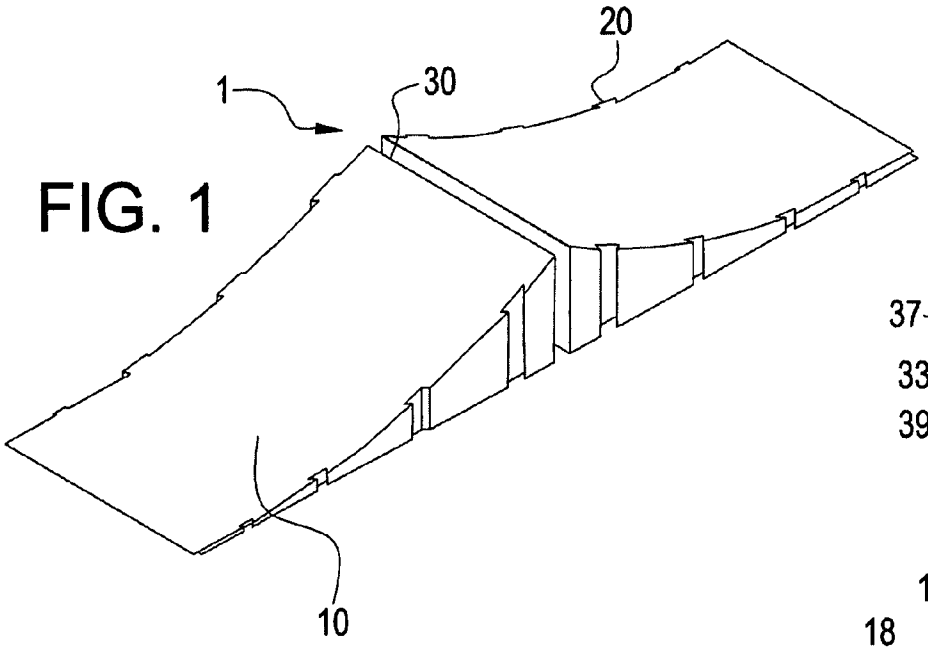
FIG. 1 shows a perspective view of a first aspect of the present invention consisting of two ramps connected back-to-back with a spine connector.
Figure 2:
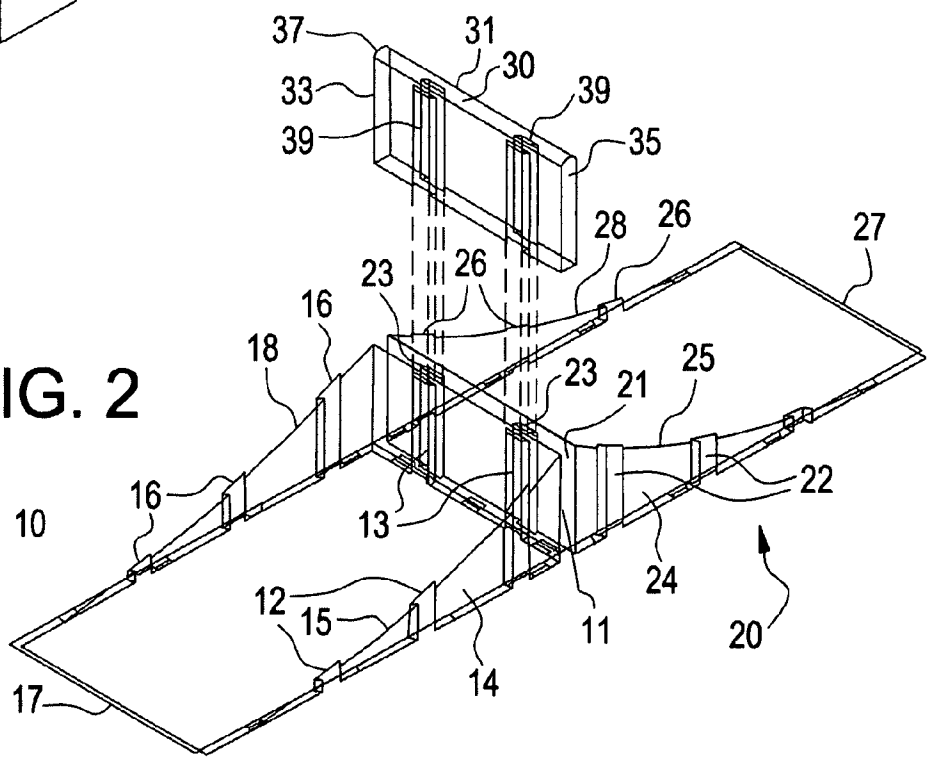
FIG. 2 shows an exploded perspective view of the invention of FIG. 1 showing more details of the spine connector.

Reference is first made to FIGS. 1-7 so that a first aspect of the present invention may be disclosed in detail. With particular reference, first, to FIGS. 1 and 2, it is seen that a first ramp 10 and a second ramp 20 are oriented with rear walls or faces 11 and 21, respectively, facing one another. As best seen in FIG. 2, the rear walls or faces 11 and 21, while facing one another, are spaced apart in parallel planes. Each of the rear walls or faces 11 and 21 of the ramps 10 and 20 has connector halves comprising rearwardly extending dovetail projections generally designated by the reference numerals 13 and 23, with each ramp having two such dovetail projections extending outwardly from the rear faces thereof. Corresponding structure is also seen with particular reference to FIG. 11 which will be described in greater detail hereinafter.

The ramps 10 and 20 have radiused ramp surfaces 15 and 25, respectively, as well as forward edges 17 and 27, respectively. The ramps 10 and 20 are preferably manufactured as a one-piece molded plastic construction.

As also seen with reference to FIGS. 1 and 2, the ramp 10 includes laterally disposed connector halves comprising dovetail recesses 12 extending inwardly from a side wall 14 thereof, and laterally extending connector halves comprising dovetail projections 16 of which three are shown extending laterally outwardly from the wall 18. Similarly, the ramp 20 has a side wall 24 into which are recessed connector halves comprising three dovetail recesses 22, while the opposite wall 28 has three connector halves comprising dovetail projections 26 emanating outwardly therefrom.

As also shown in FIG. 2, a spine connector 30 includes opposed generally vertical generally parallel walls 31 and 33 as well as ends 35 and 37. Each of the walls 31 and 33 includes connector halves comprising a pair of dovetail recesses 39 which are spaced apart and sized and configured to couple with the dovetail projections 13 and 23 of the respective ramps 10 and 20 to create the combined ramp system depicted in FIG. 1 and generally designated by the reference numeral 1, consisting of the ramp 10, the ramp 20, and the spine connector 30. FIGS. 4-7 show further details concerning the spine connector 30. Thus, FIG. 4 clearly shows the front and rear walls 31, 33, the side walls 35 and 37, and the dovetail grooves 39. FIG. 5 shows a side view of the spine connector 30 with the inversely radiused top edge 32 being shown in detail along with a schematic depiction of two of the grooves 39. FIG. 6 shows a view of the front surface 31 showing the radiused top edge 32, the side walls 35 and 37, and two of the dovetail grooves 39 showing that they terminate at 34 short of the radiused top edge 32. This termination point 34 limits the extent to which the spine connector 30 can descend when being installed between the ramps 10 and 20, and serves to guarantee the appropriate alignment of the radiused surface 32 of the spine connector 30 with respect to the top terminations of the ramp surfaces 15 and 25 of the ramps 10 and 20, respectively. In connected configuration, the rear walls 11 and 21 are generally parallel.

Figure 4:
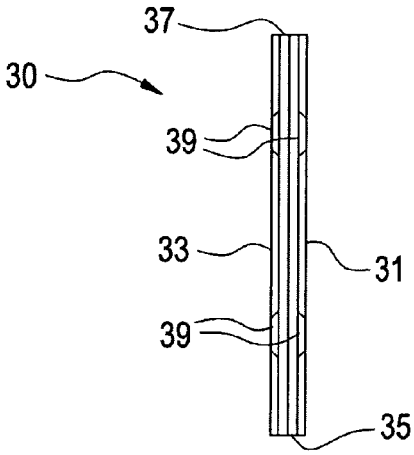
FIG. 4 shows a top view of the spine connector.
Figure 5:
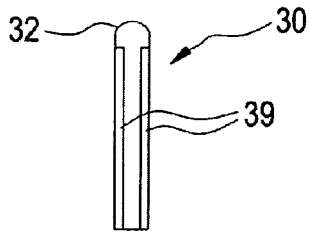
FIG. 5 shows a front view of the spine connector.
Figure 6:
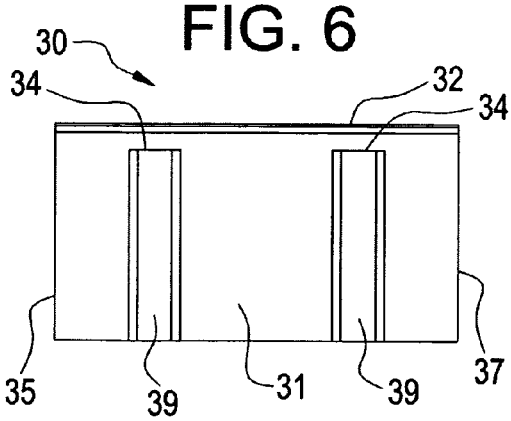
FIG. 6 shows a right side view of the spine connector.
Figure 7:
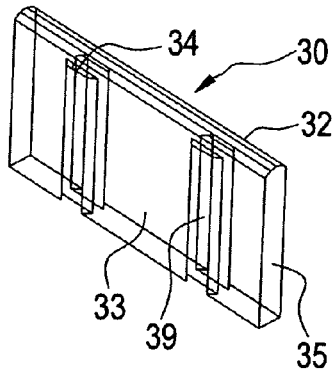
FIG. 7 shows a perspective view of the spine connector.

FIG. 7 shows a perspective view of the spine connector 30 showing many of the details shown in FIGS. 4-6 in detail.

Reference is now made to FIGS. 8-11 which show further details of a ramp in accordance with the teachings of the present invention.

Figure 8:
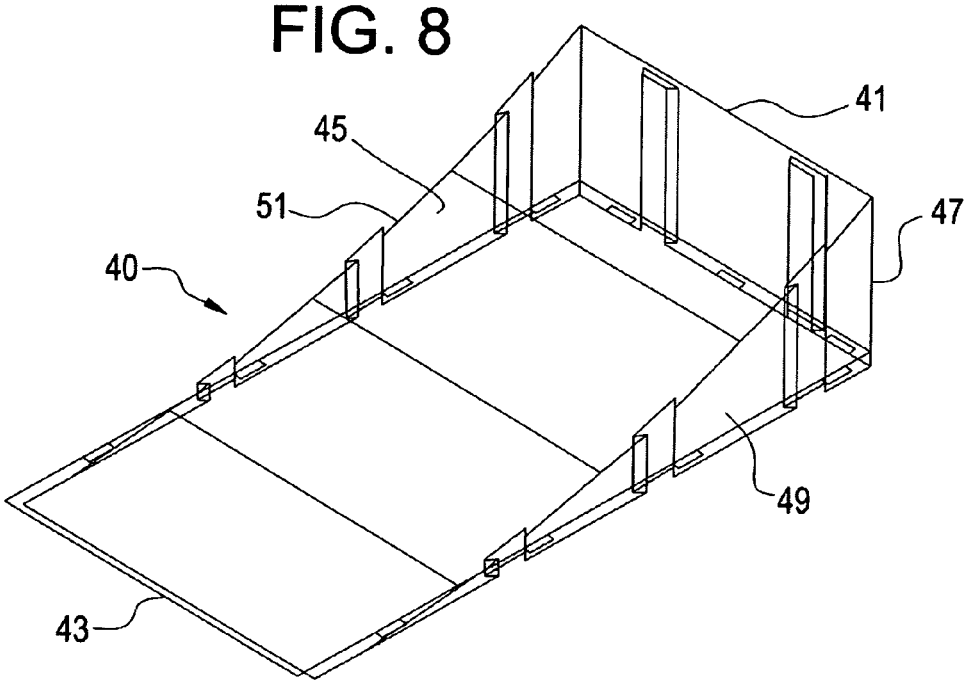
FIG. 8 shows a perspective view of a ramp showing dovetail connectors about its periphery.

FIG. 8 shows a ramp 40 that includes a rear edge 41, a forward edge 43, a ramp surface 45 that is radiused, a rear wall 47, and side walls 49 and 51.

Figure 11:
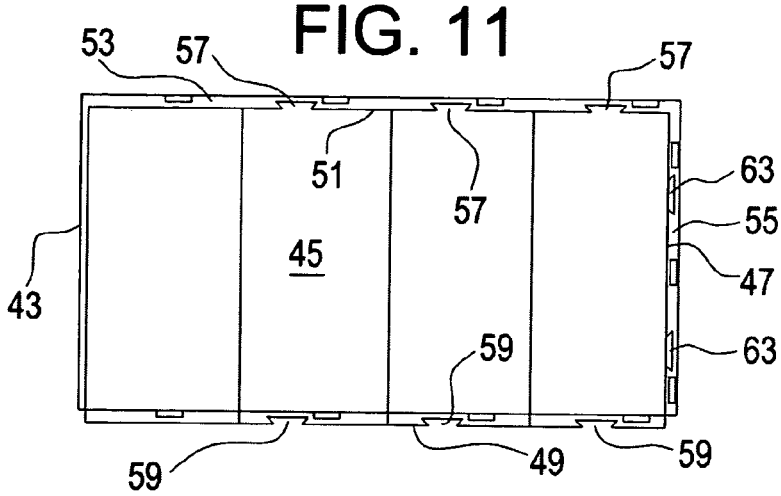
FIG. 11 shows a top view of the ramp of FIGS. 8-10.

As seen in FIG. 11, in particular, a peripheral edge 53 extends laterally of the bottom of the side wall 51, and a peripheral edge 55 extends rearward of the rear wall 47.

With further reference to FIG. 11, it is seen that the side wall 51 includes three dovetail projections, all designated by the reference numeral 57, while the side wall 49 includes three dovetail recesses 59. As seen from comparing FIGS. 8 and 11, the dovetail grooves 59 and projections 57 extend the entire length of the side walls at their respective locations. As should be understood, the reason why one side wall includes dovetail projections and one side wall includes dovetail grooves is that when two ramps 40 are to be mounted laterally adjacent one another, the dovetail projections of one side wall of one ramp enter the dovetail grooves of one of another side wall of the other ramp so that the two ramps may be laterally coupled together.

Figure 9:
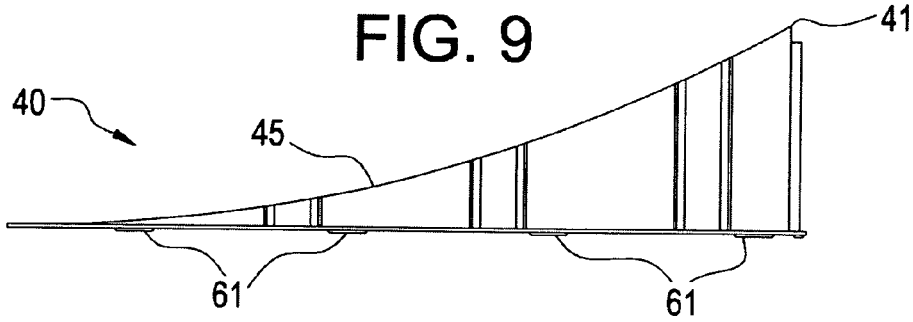
FIG. 9 shows a side view of the ramp of FIG. 8.

With reference to FIG. 9, the ramp 40 includes rubber feet 61 on its bottom surface which are designed to grip a ground surface on which the ramp 40 is placed so that it does not move when a skateboarder skates onto the radiused surface 45.

With further reference to FIGS. 8-11, it is seen that the rear surface 47 of the ramp 40 has two dovetail projections 63 facing rearward thereof. As explained with reference to FIGS. 1-7, a spine connector 30 may be used to couple the ramp 40 with adjacent structure with the spine connector including corresponding dovetail recesses as particularly shown with reference to FIGS. 4-7.

Figure 10:
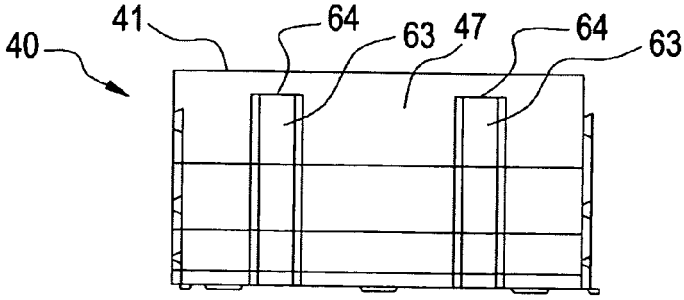
FIG. 10 shows a rear view of the ramp of FIGS. 8-9.

FIG. 10 particularly shows the rear surface 47 of the ramp 40 and shows that the dovetail projections 63 have upper terminations 64 for the same reason as is the case with the upper terminations 34 of the dovetail projections 39 of the spine connector 30 as seen in FIG. 6.

Figure 12:
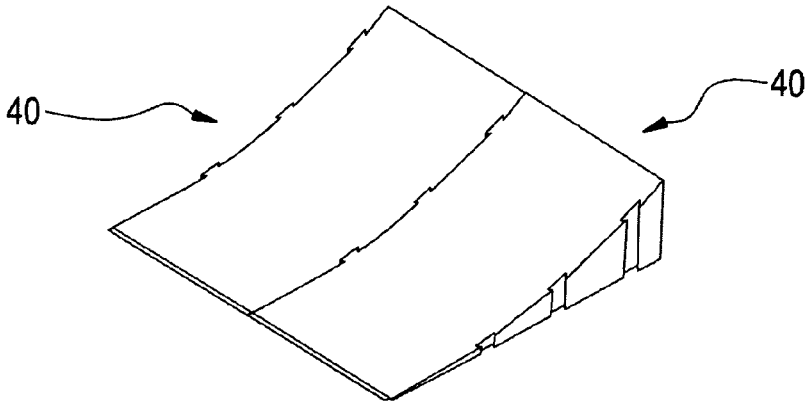
FIG. 12 shows a plurality of ramps such as shown in FIGS. 8-11 assembled together laterally.
Figure 13:
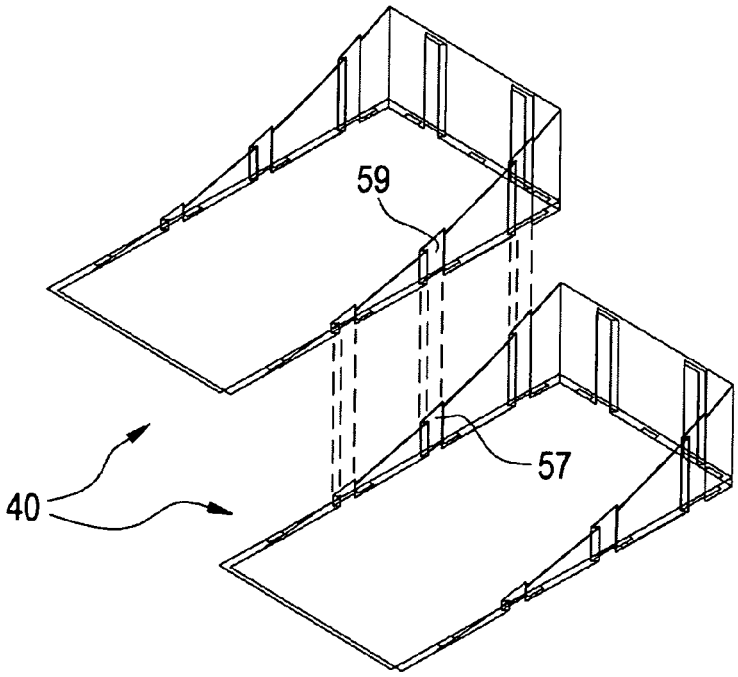
FIG. 13 shows an exploded perspective view of the ramp configuration of FIG. 12 showing the manner of interconnection of two laterally disposed ramps.

With reference to FIGS. 12 and 13, two ramps 40 are seen laterally interconnected together with the respective dovetail recesses 59 and dovetail projections 57 (FIG. 11) intermeshing to maintain the ramps 40 in the arrangement shown, in particular, in FIG. 12. FIG. 13 clearly depicts the interaction between the dovetail recesses 59 and dovetail grooves 57.

Figure 14:
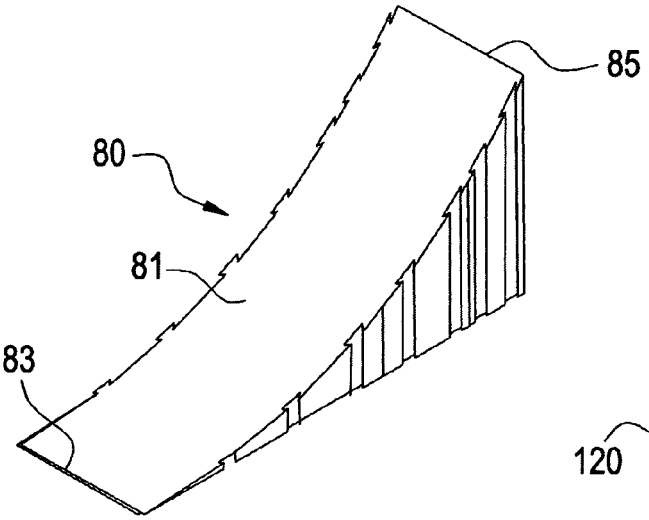
FIG. 14 shows a perspective view of a ramp made up of a plurality of sections assembled together.

Reference is now made to FIGS. 14-23 which depict the details of a ramp made up of a plurality of ramp sections assembled together using the dovetail recesses and dovetail projections as explained hereinabove. Reference is first made to FIG. 14 which shows a composite ramp 80 made up of (FIG. 15) a lower section 100, an intermediate section 120, and an upper section 140. As seen in FIG. 14, the composite ramp 80 includes a radiused ramp surface 81 made up of ramp portions from the three sections 100, 120 and 140, as well as a front edge 83 which is a portion of the ramp section 100, and a rear edge 85 which is a portion of the rear section 140.

Figure 15:
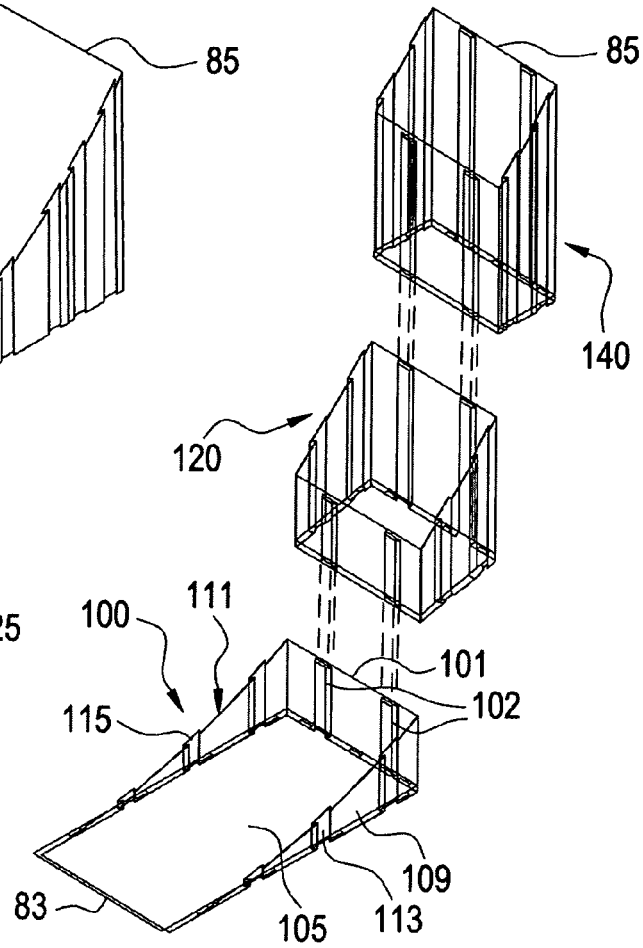
FIG. 15 shows an exploded perspective view of the ramp of FIG. 14 showing the manner of interconnection of the components.

With reference to FIG. 15, the ramp section 100 is quite similar to the ramp 40 depicted in FIG. 8 including all of the features thereof. Thus, the ramp section 100 includes a rear edge 101, sides 109 and 111, and a ramp surface 105. It also includes dovetail recesses 113 on the side wall 109 and dovetail projections 115 on the side wall 111.

Figure 16:
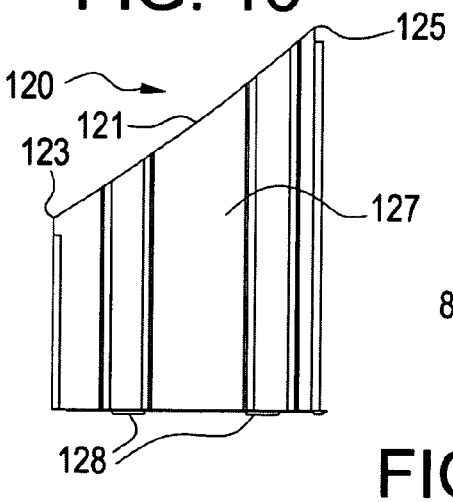
FIG. 16 shows a side view of the middle component of the ramp of FIGS. 14-15.
Figure 17:
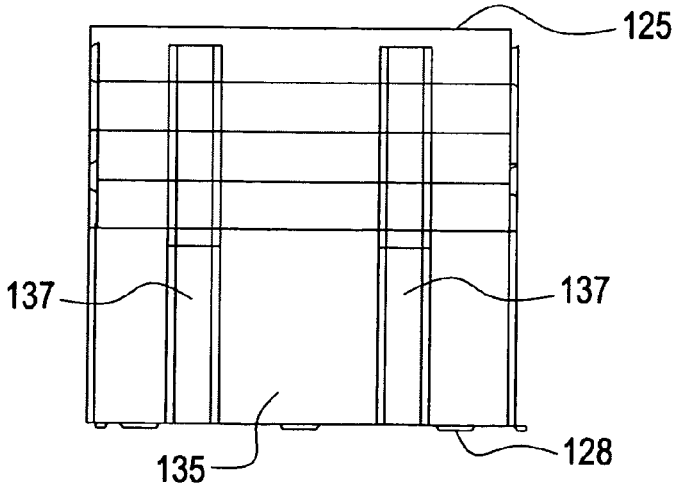
FIG. 17 shows a rear view of the ramp component of FIG. 16.
Figure 18:
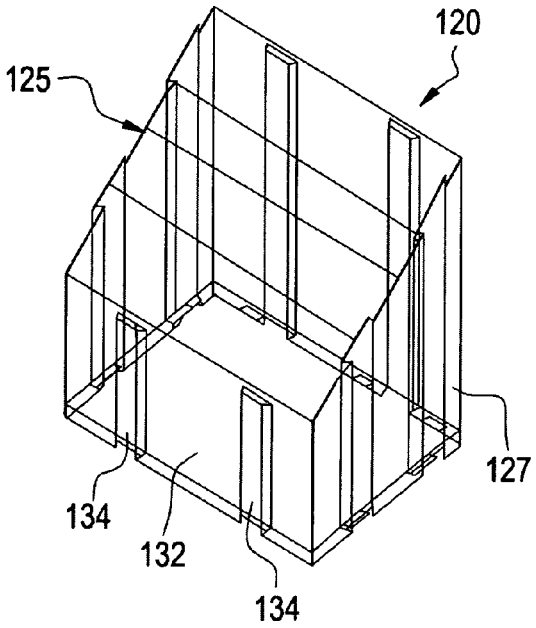
FIG. 18 shows a perspective view of the ramp component of FIGS. 16 and 17 enlarged from its view in FIG. 15.
Figure 19:
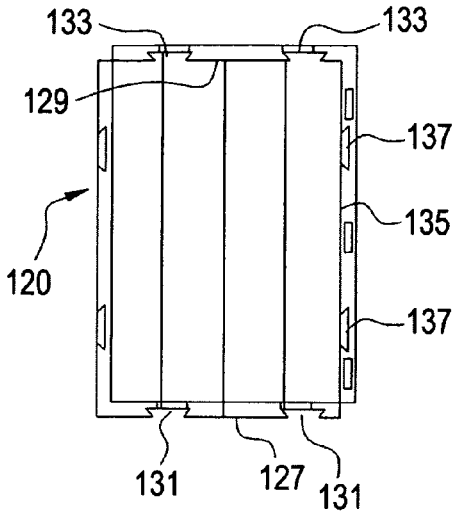
FIG. 19 shows a top view of the ramp component of FIGS. 17 and 18.
Figure 20:
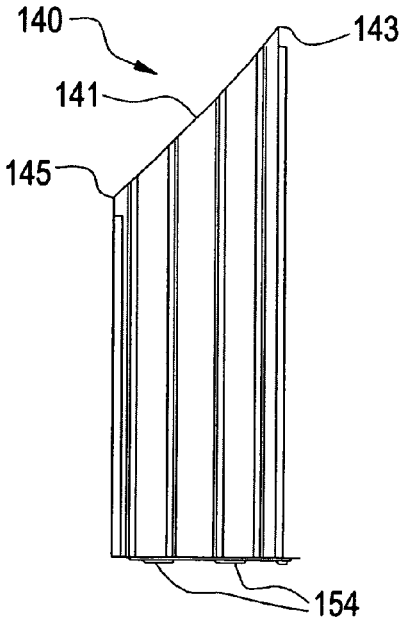
FIG. 20 shows a side view of the rearmost component of the ramp of FIG. 15.
Figure 21:
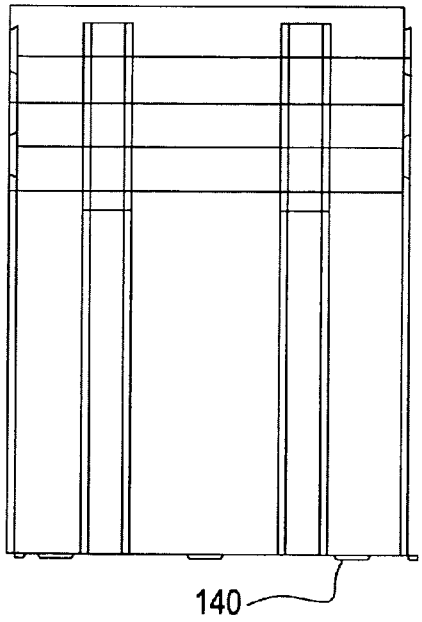
FIG. 21 shows a rear view of the ramp component of FIG. 20.

With reference to FIGS. 16-19, the ramp portion 120 includes a radiused ramp surface 121, a front edge 123, a rear edge 125, and side walls 127 and 129. The surface 127 includes a pair of dovetail recesses 131, while the side wall 129 includes a pair of dovetail projections 133. The rear wall 135 includes a pair of dovetail projections 137. With reference to FIG. 18, recesses 134 are seen in the front surface 132 of the ramp section 120. These recesses 134 mesh with the dovetail projections 102 on the rear wall of the ramp section 100. With further reference to FIG. 16, rubber non-slip feet inserts 128 are mounted on the undersurface of the ramp section 120 to preclude movement when a skateboarder is traveling over the surface 121 thereof. As should be understood, the elevation of the front edge 123 of the ramp section 120 is the same as the elevation of the rear edge 101 of the ramp section 100 so that a smooth transition therebetween exists when the ramp section 120 is assembled to the ramp section 100.

With reference to FIGS. 20-23, the ramp section 140 includes a radiused surface 141 having a rear termination 143 and a forward termination 145 that is at the same elevation as the rear termination 125 of the ramp section 120 so that a smooth transition therebetween occurs when the ramp sections 120 and 140 are assembled together.

Figure 22:
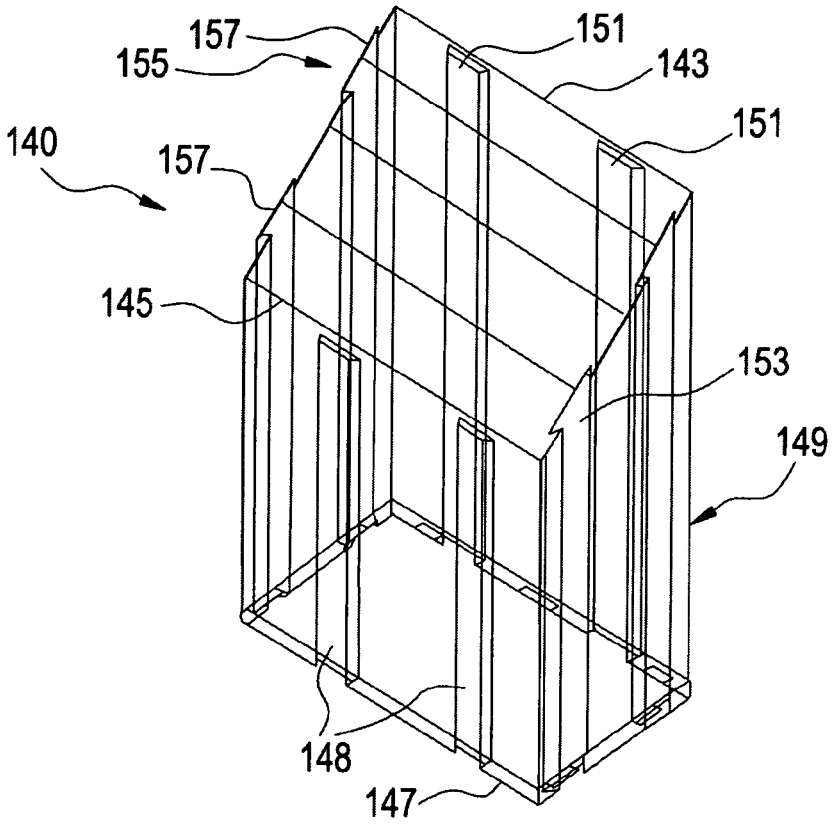
FIG. 22 shows a perspective view of the ramp component of FIGS. 20 and 21 enlarged from the view of FIG. 15.
Figure 23:
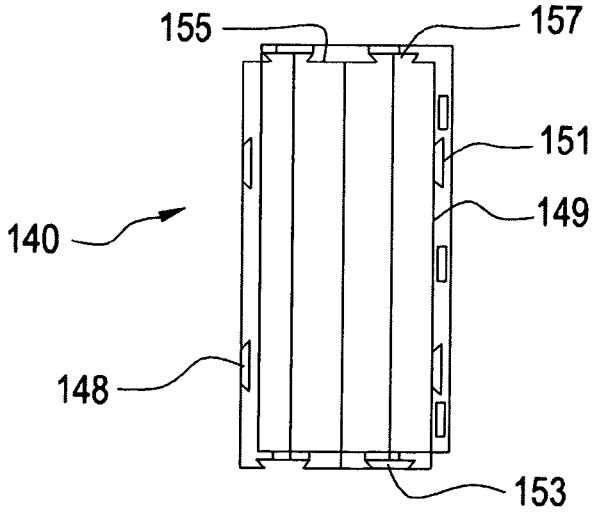
FIG. 23 shows a top view of the ramp component of FIGS. 20-22.

With reference to FIG. 22, the ramp section 140 includes a front wall 147 and a rear wall 149, with the rear wall including dovetail projections 151. The side wall 149 includes a pair of dovetail recesses 153, while the side wall 155 has a pair of dovetail projections 157. The front wall 147 includes a pair of dovetail recesses 148 that couple with the dovetail projections 137 of the rear wall 135 of the ramp section 120 when the sections 120 and 140 are assembled together. As is the case with the ramp sections 100 and 120, the ramp section 140 includes rubber non-slip feet inserts 154 for the same purpose as explained earlier with respect to the sections 100 and 120.

As should be understood from review of FIGS. 14-23, the ramp sections 100, 120 and 140 are assembled together with dovetail projections entering dovetail grooves so that when the assembly has taken place, the ramp surface best seen in FIG. 14 and designated by the reference numeral 81 is smooth from the front edge 83 of the ramp 80 to the rear edge 85 thereof.

As should be understood, as explained earlier with reference, for example, to FIG. 12, the side walls of each ramp section have dovetail grooves on one side wall and dovetail projections on the other side wall so that ramps and ramp systems can be assembled together laterally to create wider ramps than is the case where a single ramp or single ramp section is provided.

Figure 25:
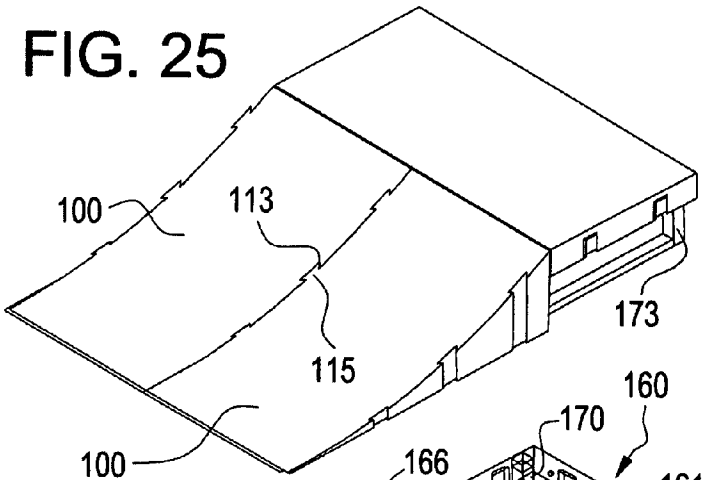
FIG. 25 shows ramps such as shown in FIG. 12 laterally combined together with a table rotated 90 degrees from its orientation shown in FIG. 24.
Figure 24:
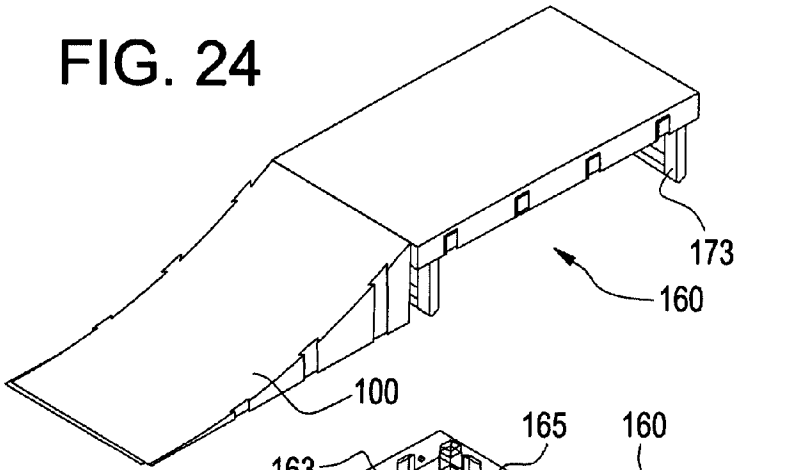
FIG. 24 shows a ramp similar to that shown in FIG. 8 coupled together with a table.
Figure 27:
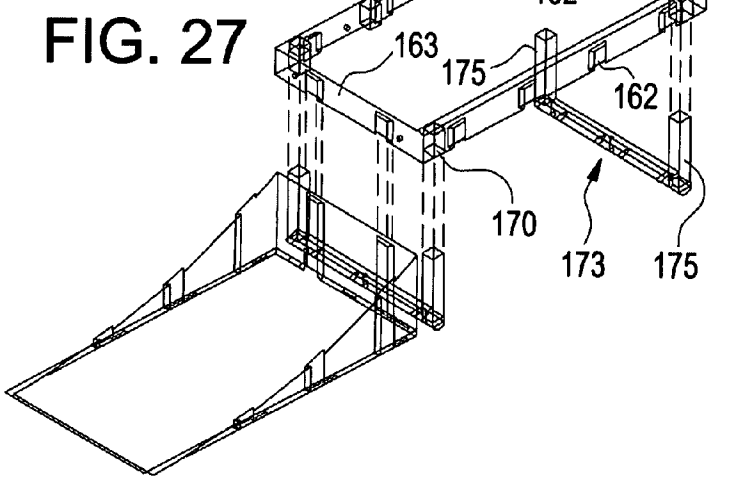
FIG. 27 shows an exploded perspective view showing the assembly of the table to the ramp of FIG. 24.
Figure 26:
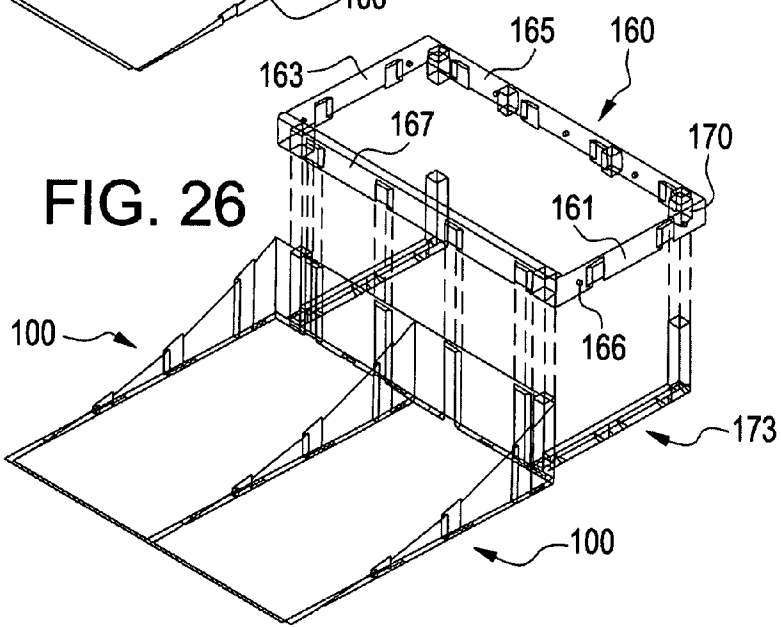
FIG. 26 shows an exploded perspective view showing the manner of assembly of the table to the ramps of FIG. 25.

Now, reference is made to FIGS. 24-29 so that description of the manner of assembly of the inventive table and alternate ways it is used can be described. With reference first to FIGS. 26 and 27, the periphery of the table 160 is shown with the top surface omitted to show details. As seen in FIGS. 26 and 27; the table 160 is generally rectangular and includes short sides 161 and 163 as well as long sides 165 and 167, each of which have side surfaces as shown. The short sides 161 and 163 include connector halves comprising two dovetail recesses 162, while the longer sides 165 and 167 include connector halves comprising four dovetail recesses 162. These dovetail recesses 162 are provided to facilitate releasable coupling to other components such as the ramp 100 seen in FIG. 24 or the plurality of ramps 100 seen in FIG. 25.

As explained earlier with reference, for example, to FIG. 15, the ramp 100 includes rearwardly facing dovetail projections 102. Thus, the dovetail recesses 162 in the table 160 which are located on the end 161 or the end 163 may be coupled with the dovetail projections 102 of the ramp 100 in the scenario illustrated in FIG. 24. The scenario illustrated in FIG. 25, by contrast, resembles the situation shown in FIG. 12 with the two ramps 40 in which the ramps 100 are laterally connected together with the dovetail recesses 113 on the side of the left-hand ramp 100 coupling with the dovetail projections 115 on the other side of the ramp 100 as shown. When the ramps 100 are releasably coupled together as shown in FIG. 25, the four dovetail recesses on the side 165 or 167 of the table 160 are coupled with the two dovetail projections 102 on each ramp 100. The table 160 also includes a plurality of downwardly open rectangular recesses sized and configured to receive the posts 175 of leg assemblies 173. FIGS. 26 and 27 show the manner of assembly of the posts 175 to the rectangular recesses 170.

Figures 28, 29, 30, 31, 32:
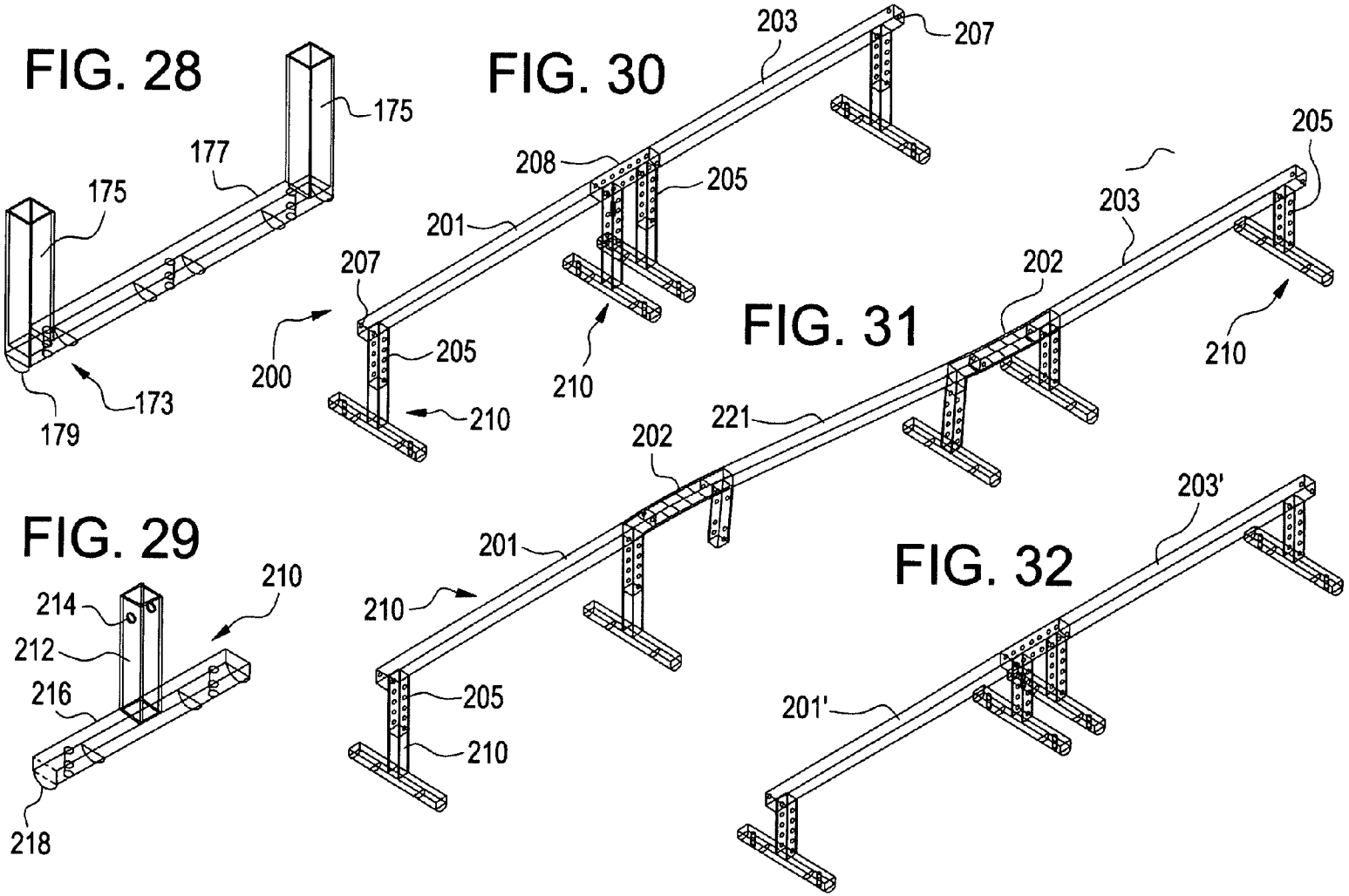
FIGS. 28 and 29 show perspective views of the legs used to support tables and rails in accordance with the teachings of the present invention.
FIGS. 30-32 show configurations of rails including support legs.

FIG. 28 shows further details of a leg assembly 173. In particular, the posts 175 are interconnected by a horizontal ground engaging member 177 which has an arcuate ground engaging surface 179. Thus, the ground engaging surface 179 engages a ground surface with a line contact. If the table is located on a surface that is sloped with respect to the horizontal, the arcuate surfaces 179 of the leg assemblies 173 mounted on the underside of the table 160 allow stable support of the table 160.

Figure 40:
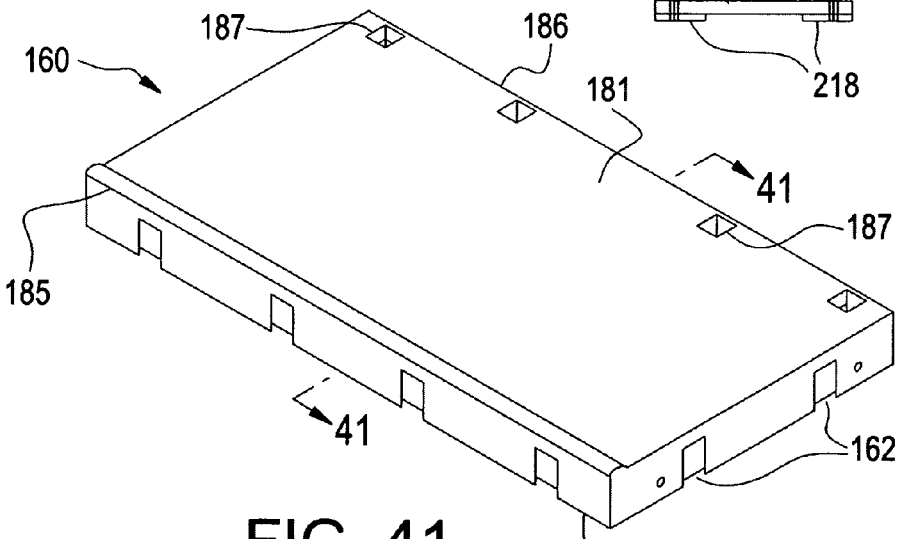
FIG. 40 shows a perspective view of the support surface of a table including the provision of integral coping on the periphery.
Figure 41:
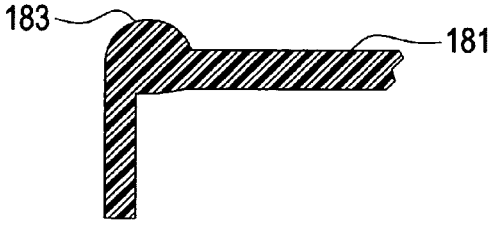
FIG. 41 shows a cross-sectional view along the line 41-41 of FIG. 40.

FIGS. 40 and 41 show further details of the table 160. As seen in FIG. 40, the table 160 has a substantially flat top or upper surface 181, but an edge of the surface 181 designated by the reference numeral 183 comprises a bump that may be better described as an integral plastic coping. This is seen with reference to FIG. 40. This integral coping 183 comprises a protective feature running parallel with an edge of the table so that if a skateboarder ventures too close to the edge 185 of the surface 181, the coping bump 183 provides an indication to the skateboarder that they should move back away from that edge.

As also seen in FIG. 40, a plurality of rectangular recesses or holes 187 are provided along the edge 186 of the surface 181 opposite to the edge 185. These recesses or holes 187 are provided to receive support posts for a rail, railing or a grind rail as will be described in greater detail hereinafter. FIG. 40 also shows the dovetail recesses surrounding the periphery of the table 160.

Figure 42:
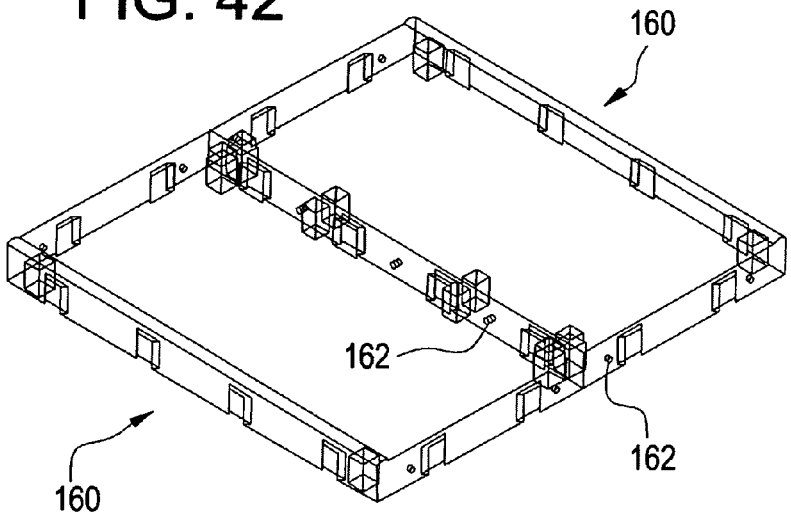
FIGS. 42-43 show perspective views of the periphery of tables showing deck connection details.
Figure 43:
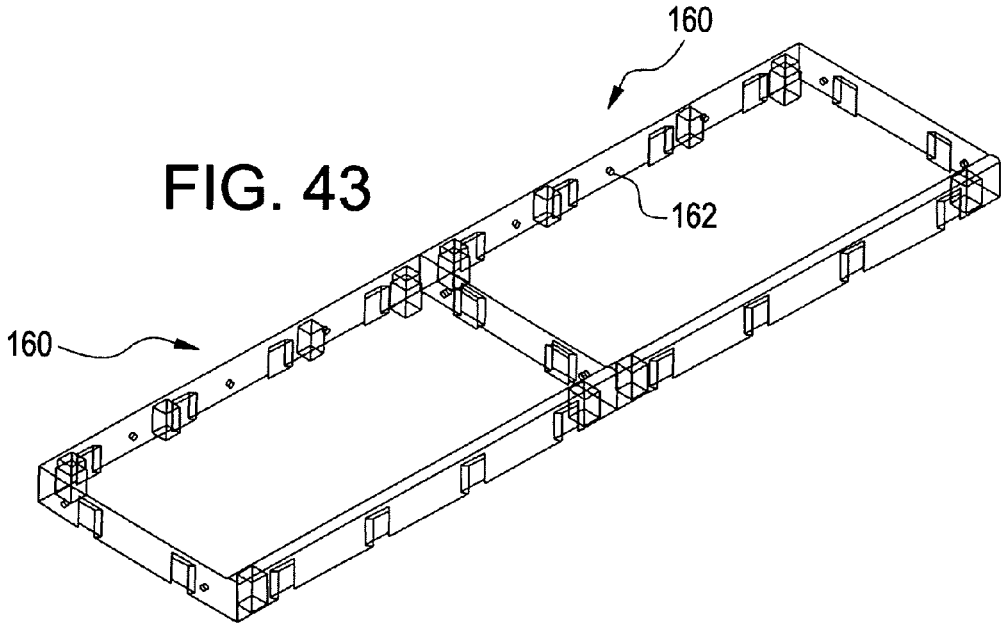

With reference back to FIGS. 26 and 27, it is seen that the periphery of the table 160 includes a plurality of spaced holes 166 for a purpose to be described in greater detail hereinafter. In this regard, reference is made to FIGS. 42 and 43. As explained above, the periphery of the table 160 includes dovetail recesses 162. No dovetail projections are provided. Thus, when it is desired to fasten together a plurality of tables 160, the dovetail recesses 162 perform no function. Thus, in order to interconnect tables 160 in the configurations shown, for example, in FIGS. 42 and 43, the holes 162 on respective tables 160 are aligned together and threaded fasteners with washers and threaded nuts (not shown) are used to releasably couple a plurality of tables 160 together in any one of a number of configurations.

Reference is now made to FIGS. 29-39 so that a description of a grind rail system forming a part of the present invention may be described in detail. FIGS. 30-32 show three examples of a grind rail system in accordance with the teachings of the present invention. FIG. 30 shows a system 200 including rails 201 and 203. The rail 201 includes integral downwardly depending rectangular cross-section leg stubs 205 and legs 210 releasably coupled to the leg stubs 205. For this purpose, holes on the legs 210 align with holes on the leg stubs 205 and pins (not shown) are extended through the aligned holes to couple the legs 210 to the leg stubs 205. As seen in FIG. 30, the leg stubs 205 have a plurality of spaced hole pairs so that the height of the grind rail 200 may be selectively chosen.

Each rail 201 has holes 207 at its ends designed to facilitate coupling of adjacent rails together. Thus, in the example of FIG. 30, a straight connector 208 couples the rails 201 and 203 together. The connector 208 has outer dimensions designed to facilitate slidable receipt within the openings through the respective rails 201 and 203. The holes 207 of the rails 201 and 203 are aligned with respective pairs of the holes in the connector 208 and pins (not shown) are used to couple the rails 201 and 203 together using the connector 208.

FIG. 29 shows further details of a leg 210. Those details include an upstanding connector stub 212 having a pair of opposed holes 214 at its upper end and a horizontal ground engaging leg 216 having an arcuate ground engaging surface 218 for the same reasons as set forth above with respect to the ground engaging surface 179 on the leg assembly 173. Similar to the ground engaging surface 179 of the leg assembly 173, the ground engaging surface 218 of the leg 210 comprises an elongated arcuate piece of rubber suitably fastened to be an integral part of the leg 216 to provide both a cushioning effect and to preclude undesired lateral movements of a grind rail system such as the grind rail system 200.

FIG. 31 shows a system 220 similar to the system 200. The difference is that instead of using connectors 208 which are straight, curved connectors 202 are provided. The rails 201 and 203 are now separated by a rail 221 and the connectors 202 are arcuate so that from the rail 201 to the rail 221 the transition is a downward curve, and between the rails 221 and 203, the connector 202 is inverted with respect to its orientation between the rails 201 and 221 to straighten out so that the rails 201 and 203 are not axially aligned as they are in the configuration 200 shown in FIG. 30 but, rather, are parallel with the rail 201 being at a higher elevation than the rail 203. The adjustability of height between the leg stubs 205 and the legs 210 is shown by comparison of these structures on the rail 201 as compared to the rail 203.

FIG. 32 shows a grind rail system 230 similar to that of the grind rail system 200, but with the rails 201' and 203' set at a lower elevation.

Figure 33:
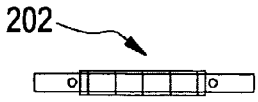
FIGS. 33-39 show a variety of components of rails and tables.
Figure 35:
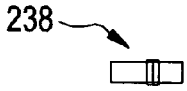
Figure 37:
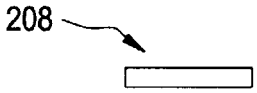

FIG. 37 shows further details of a connector 208. FIG. 35 shows further details of a table down connector 238, and FIG. 33 shows further details of a curved connector 202.

Figure 34:
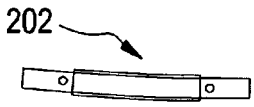
Figure 36:
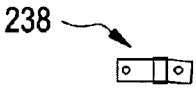

FIG. 34 shows a side view of the curved connector 202 showing a preferred degree of curvature. FIG. 36 shows a side view of the table down connector 238 showing the angle down of the right side with respect to the straight left side.

Figure 38:
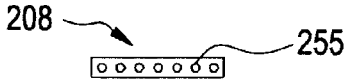

FIG. 38 shows further details from the side of the straight connector 208 showing a plurality of holes 225.

Figure 39:
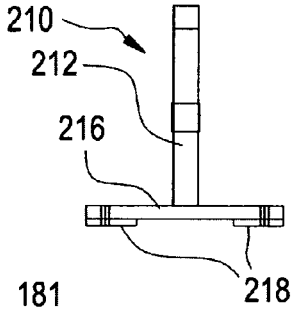

FIG. 39 shows further details of the leg 210 as also described with respect to FIG. 29. As seen in FIG. 39, the rubber feet 218 are shown in more detail.

As should be understood by those skilled in the art, with the various components described above as part of a modular skateboarding ramp system, there are numerous possibilities concerning combining together of the various components to provide diverse experiences for a skateboarder. Several examples of such combinations are described below.

Figure 44:
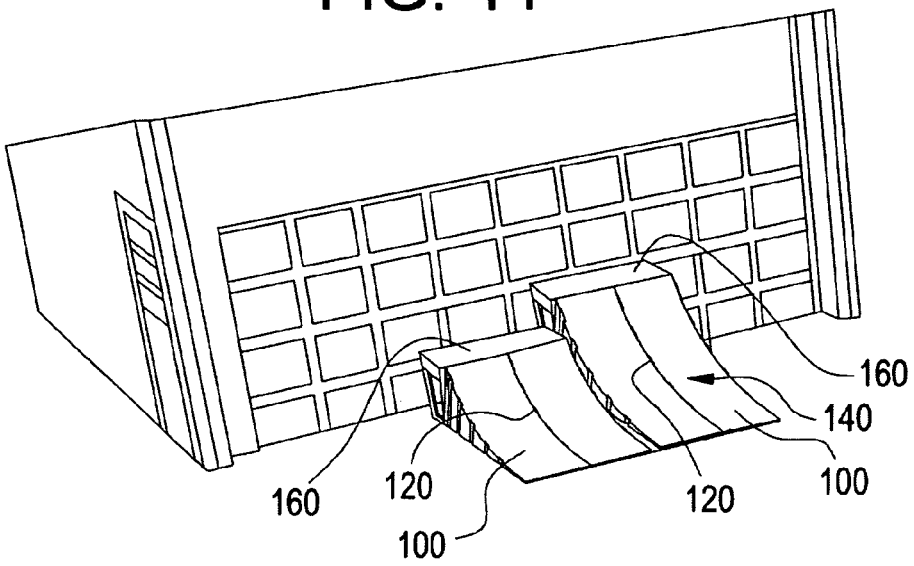
FIG. 44 shows a combination of two ramps of differing heights laterally connected together with rearward tables affixed thereto.

FIG. 44 shows a combination in which a ramp made up of sections 100 and 120 (FIG. 15) is mounted laterally to a ramp made up of sections 100, 120 and 140. At the rear of each of the laterally adjacent ramps, a table 160 is provided. As seen in FIG. 44, one table has a higher elevation than the other table by virtue of inclusion of the third section 140.

Figure 3:
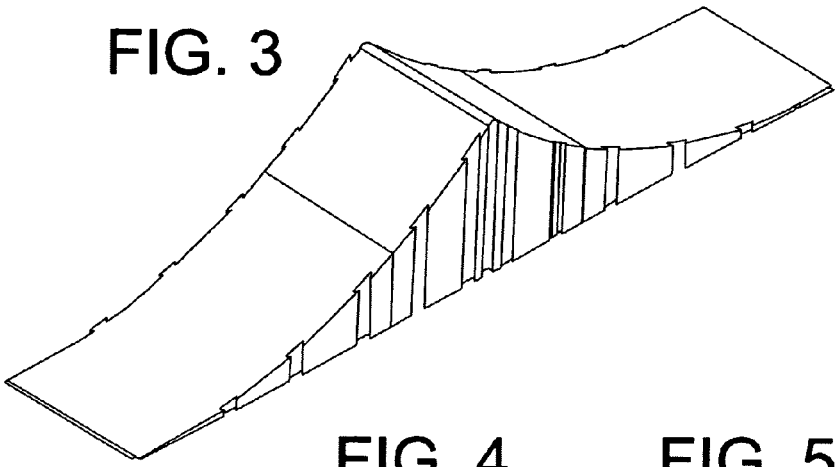
FIG. 3 shows a view similar to that of FIG. 1, but depicting back-to-back ramps formed with a plurality of sections assembled together and with a higher elevation than the ramps of FIGS. 1-2.
Figure 45:
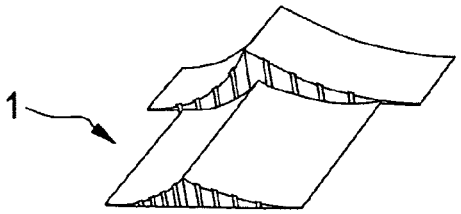
FIG. 45 shows two pairs of back-to-back connected ramps laterally connected together.

With reference to FIG. 45, as well as FIGS. 1 and 3, a system 1 consisting of two ramps 10 and 20 oriented back-to-back with a spine connector 30 therebetween is located laterally adjacent to a similar system corresponding to FIG. 3 in which the ramps are longer and their elevation is higher. Using the dovetail recesses and projections as described hereinabove, the two back-to-back ramp systems are releasably coupled together.

Figure 46:
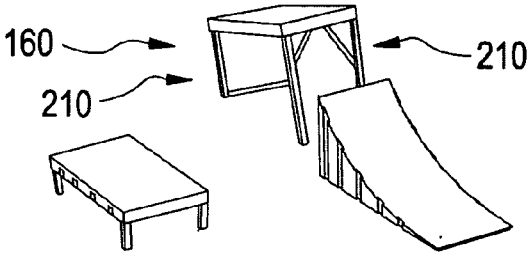
FIG. 46 shows a combination of an angled table and a ramp with the angulation of the table being adjustable.

FIG. 46 shows a table 160 in which the front support legs 210 are adjusted to be longer than the rear support legs 210 so that the table 160 is angled with respect to the adjacent ground surface. In this configuration, the arcuate rubber feet 218 (FIG. 29) allow line contact with the ground surface so that the table 160 does not wobble as so supported.

Numerous other possible combinations are contemplated in accordance with the teachings of the present invention, only limited by the imagination of the user. The dovetail grooves and projections may be used to couple various components together. Where this is not possible, the use of threaded fasteners and nuts or other fastening means may be employed, for example, as explained in FIGS. 42-43.

The openings 187 in the table 160 surface 181 may be used to support a hand rail as well as the posts of a grind rail such as those illustrated with particular reference to FIGS. 30-32.

Accordingly, an invention has been disclosed in terms of preferred embodiments thereof which fulfill each and every one of the objects of the invention as set forth hereinabove, and provide new and useful embodiments of a modular ramp system of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A modular ramp system, comprising:

a) a first ramp having a first front edge, a first rear wall and a first ramp surface;

b) a second ramp having a second front edge, a second rear wall and a second ramp surface;

c) each of said first and second rear walls having a first half of a connector thereon; and d) a spine connector having a first generally vertical wall and a second generally vertical wall, each of said generally vertical walls having a second half of said connector thereon, wherein said spine connector includes an inverted radiused top surface providing a smooth transition between said first and second ramp surfaces;

e) said first and second ramps being releasably assembled together by orienting said rear walls to face one another and coupling said first connector halves of said rear walls to respective ones of said second connector halves on said generally vertical walls of said spine connector.

2. The system of claim 1, wherein said first and second rear walls are generally parallel when facing one another.

3. The system of claim 2, wherein said generally vertical walls of said spine connector are generally parallel.

4. The system of claim 1, wherein said ramp surfaces are radiused.

5. The system of claim 1, wherein said connector comprises a dovetail groove and a dovetail projection.

6. The system of claim 1, wherein each of said ramps includes side walls, each of said side walls having one half of a connector thereon, whereby ramps may be laterally interconnected.

7. The system of claim 6, wherein laterally interconnected ramps have equal heights.

8. The system of claim 6, wherein laterally interconnected ramps have differing heights.

9. A modular ramp system, comprising:

a first ramp having a first front edge, a first rear wall and a first ramp surface;

a second ramp having a second front edge, a second rear wall and a second ramp surface;

each of said first and second rear walls having a first portion of a connector thereon; and a spine connector having a first generally vertical wall and a second generally vertical wall, each of said generally vertical walls having a second portion of said connector thereon, said spine connector including an inverted radiused top surface providing a smooth transition between said first and second ramp surfaces;

said first and second ramps being releasably assembled together by orienting said first and second rear walls to face one another and coupling said first portion of said connector to said second portion of said connector.

10. The system of claim 9, wherein said first and second rear walls are generally parallel when facing one another.

11. The system of claim 10, wherein said generally vertical walls of said spine connector are generally parallel.

12. The system of claim 9, wherein at least one of said first and second ramp surfaces includes a section that is radiused.

13. The system of claim 9, wherein:

each of said first and second ramps includes side walls; and each of said side walls includes a connector thereon for enabling additional ramps to be laterally interconnected.

14. The system of claim 13, wherein said additional ramps have one of equal heights and differing heights.

15. A modular ramp system, comprising:

a first ramp having a first front edge, a first rear wall and a first ramp surface;

a second ramp having a second front edge, a second rear wall and a second ramp surface;

each of said first and second rear walls having a first section of a connector thereon; and a spine connector having a second section of said connector thereon, said spine connector including an inverted radiused top surface providing a smooth transition between said first and second ramp surfaces;

said first and second ramps being releasably assembled together by orienting said first and second rear walls to face one another and coupling said first section of said connector to said second section of said connector.

16. The system of claim 15, wherein said first and second rear walls are generally parallel when facing one another.

17. The system of claim 15, wherein said spine connector includes generally vertical walls that are generally parallel.

18. The system of claim 15, wherein at least one of said first and second ramp surfaces includes a section that is radiused.

19. The system of claim 15, wherein each of said first and second ramps includes side walls, and each of said side walls includes a portion of a connector thereon for enabling additional ramps to be laterally interconnected.

20. The system of claim 19, wherein said additional ramps have one of equal heights and differing heights.

* * * * *